US008156906B2

(12) United States Patent
Takenaka

(10) Patent No.: US 8,156,906 B2
(45) Date of Patent: Apr. 17, 2012

(54) VALVE TIMING CONTROLLER

(75) Inventor: Akihiko Takenaka, Anjo (JP)

(73) Assignee: Denso Corporation, Kariya (JP)

( * ) Notice: Subject to any disclaimer, the term of this patent is extended or adjusted under 35 U.S.C. 154(b) by 321 days.

(21) Appl. No.: 12/685,197

(22) Filed: Jan. 11, 2010

(65) Prior Publication Data

US 2010/0175651 A1 Jul. 15, 2010

(30) Foreign Application Priority Data

Jan. 14, 2009 (JP) ..... 2009-6043

(51) Int. Cl.
*F01L 1/34* (2006.01)

(52) U.S. Cl. ..... 123/90.17; 123/90.15; 464/160

(58) Field of Classification Search ..... 123/90.15, 123/90.17; 464/1, 2, 160
See application file for complete search history.

(56) References Cited

U.S. PATENT DOCUMENTS 6,814,038 B2 11/2004 Smith
7,845,321 B2 * 12/2010 Kobaishi ..... 123/90.17

FOREIGN PATENT DOCUMENTS

JP 2008-202680 9/2008

* cited by examiner

*Primary Examiner* — Ching Chang
(74) *Attorney, Agent, or Firm* — Nixon & Vanderhye PC

(57) ABSTRACT

When a spool is positioned in a lock range including a stroke end in a first direction, an advance port and a lock port are respectively connected to a supply port and a discharge port. When the spool is positioned in an advance range deviating from the lock range in a second direction, the advance port and the lock port are fluidly connected to the supply port. While a driving source generates a driving force to move the spool in the second direction, a biasing member biases the spool in the first direction. When the spool is positioned at a limit position of the advance range, a biasing force biasing the spool in the first direction is stepwise varied by a specified variation width.

6 Claims, 16 Drawing Sheets

VALVE TIMING CONTROLLER

CROSS-REFERENCE TO RELATED APPLICATION

This application is based on Japanese Patent Application No. 2009-6043 filed on Jan. 14, 2009, the disclosure of which is incorporated herein by reference.

FIELD OF THE INVENTION

The present invention relates to a valve timing controller which adjusts a valve timing of a valve by use of hydraulic fluid supplied from a supply source along with an operation of an internal combustion engine. The valve is opened and closed by a camshaft driven by a torque transmitted from a crankshaft of the internal combustion engine.

BACKGROUND OF THE INVENTION

A valve timing controller has a housing rotating with a crankshaft and a vane rotor rotating with a camshaft. The housing defines a hydraulic chamber therein. The vane rotor has a vane which divides the hydraulic chamber in a rotational direction. A rotational phase of the vane rotor relative to the housing is varied by introducing hydraulic fluid into the hydraulic chamber. JP-2004-108370A, which is a counterpart of U.S. Pat. No. 6,814,038B2, shows a valve timing controller having a spool valve which controls hydraulic fluid flow.

Specifically, in the valve timing controller, when the hydraulic fluid is discharged from a cylindrical portion, a lock pin is engaged with a recess to lock a vane rotor relative to a housing. When the hydraulic fluid is introduced into the cylindrical portion, the lock pin is disengaged from the recess to release the lock of the vane rotor. Further, the valve timing controller has a valve body provided with a plurality of ports which respectively communicate with the hydraulic chamber, the cylindrical portion, a fluid supply source, and a vent passage for discharging the hydraulic fluid. The spool valve slides in the valve body to connect and/or disconnect between the ports. When the spool valve is positioned to fluidly connect the cylindrical portion with the vent passage, the hydraulic fluid is discharged from the cylindrical portion into the vent passage, so that the vane rotor is locked. When the spool valve is positioned to fluidly connect the cylindrical portion with the fluid supply source, the lock pin is disengaged from the recess, so that the vane rotor can be rotated to vary the rotational phase thereof.

The spool valve is biased by a spring in one direction. The valve timing controller generates a driving force which moves the spool valve in the other direction against the biasing force of the spring. A lock range of the spool valve in which the vane rotor is locked is defined in such a manner as to include a stroke end of the spool valve in the biasing direction. That is, the lock range of the spool valve in which the vane rotor is locked deviates in the biasing direction from a stroke range of the spool valve in which the vane rotor can be rotated. Thus, when the hydraulic fluid supply is stopped and the driving force is not generated, the spool valve is displaced by only biasing force to lock the vane rotor, whereby an excessive vibration of the vane rotor is prevented during a successive engine start period or an engine idling period.

In the controller described above, as shown in FIG. 16, individual product variations ΔD, ΔU in driving force and biasing force applied to the spool valve are unavoidable. Thereby, relatively large variation ΔP in an axial position of the spool valve may arise, which is defined by a balance between the driving force and the biasing force, as shown in FIG. 16.

In a case that a large variation ΔP in axial position of the spool valve arises, it is necessary to set widths of the stroke range of the spool valve sufficiently large in order that the lock range where the vane rotor is locked does not overlap with the stroke range where the vane rotor is rotatable. Especially, in the valve timing controller having a configuration where the spool valve is built in the vane rotor, since it is difficult to estimate a valve characteristic, the width of the stroke range should be set sufficiently large. It may cause a long stoke of the spool valve, so that the valve timing controller becomes large in size. It is conceivable that the stroke range of the spool valve is narrowed in stead of ensuring the width of the stroke range of the spool valve. However, an adjustment width of hydraulic fluid flow rate flowing into the hydraulic chamber or the cylindrical portion becomes narrow, so that required performance can not be obtained.

SUMMARY OF THE INVENTION

The present invention is made in view of the above matters, and it is an object of the present invention to downsize a valve timing controller which realizes valve timing suitable for the internal combustion engine.

According to the present invention, a valve timing controller adjusts a valve timing of a valve by use of a hydraulic fluid supplied from a fluid supply source. The valve is opened/closed by a camshaft which is driven by a torque transmitted from a crankshaft of an internal combustion engine.

The valve timing controller includes a housing rotating synchronously with the crankshaft, and a vane rotor rotating synchronously with the camshaft. The vane rotor has a vane which divides the hydraulic chamber in its rotational direction, and varies a rotational phase of the camshaft relative to the housing with the hydraulic fluid introduced into the hydraulic chamber.

The valve timing controller further includes a lock means having a lock chamber for locking the vane rotor relative to the housing by discharging the hydraulic fluid from the lock chamber, and for unlocking the vane rotor relative to the housing by introducing the hydraulic fluid into the lock chamber.

The valve timing controller further includes a valve body including an operation port which communicates with the hydraulic chamber, a supply port which receives the hydraulic fluid from the fluid supply source, and a discharge port from which the hydraulic fluid is discharged.

The valve timing controller further includes a valve member linearly moving in a first direction and a second direction opposite to the first direction. The valve member moves to a lock range including a stroke end in the first direction in order to fluidly connect the operation port with the supply port and fluidly connect the lock port with the discharge port. The valve member moves to a stroke range deviating from the lock range in the second direction in order to connect both of the operation port and the lock port with the supply port.

The valve timing controller further includes a biasing means for generating a biasing force biasing the valve member in the first direction, and a driving source for generating a driving force driving the valve member in the second direction. The biasing means stepwise varies the biasing force when the valve member moves to be positioned at a limit position of the stroke range which confronts the lock range.

When the hydraulic fluid is discharged from the lock chamber, the vane rotor is locked relative to the housing. When the hydraulic fluid is introduced into the lock chamber, the vane rotor is unlocked relative to the housing. The valve member moves in either of the first direction and the second direction to switch a communicating condition between the operation port, the lock port, the supply port, and the discharge port.

When the valve member moves to be positioned in the lock range in which the operation port and the lock port are respectively communicate with the supply port and the discharge port, the hydraulic fluid is introduced into the hydraulic chamber and the hydraulic fluid is discharged from the lock chamber to lock the vane rotor relative to the housing. When the valve member moves to be positioned in the stroke range in which both of the operation port and the lock port communicate with the supply port, the hydraulic fluid is introduced from the fluid supply source into the hydraulic chamber and the lock chamber, so that the vane rotor can be rotated to vary the rotational phase thereof. The stroke range of the valve member deviates from the lock range in the second direction. The lock range includes a stroke end of the valve member in the first direction which corresponds to a direction of a biasing force of the biasing means. In other words, since the lock range deviates from the stroke range in the biasing direction, when the hydraulic fluid supply and the driving force are stopped, the valve member is displaced by only biasing force to lock the vane rotor.

Furthermore, when the valve member moves to be positioned at a limit position of the stroke range, the biasing force varies stepwise. Thus, even if the driving force and the biasing force have individual product variations, the driving force and the biasing force can be balanced with each other within the stepwise variation width. The variation in the limit position of the valve member, which is defined by the balance between the biasing force and the driving force, depends on only individual product variation in the biasing force. Each of the lock range and the stroke range can be narrowed as long as necessary performances are ensured without overlapping therebetween. Also, the stroke of the valve member can be shortened. Therefore, the valve timing controller can be made small in size.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figure 1:
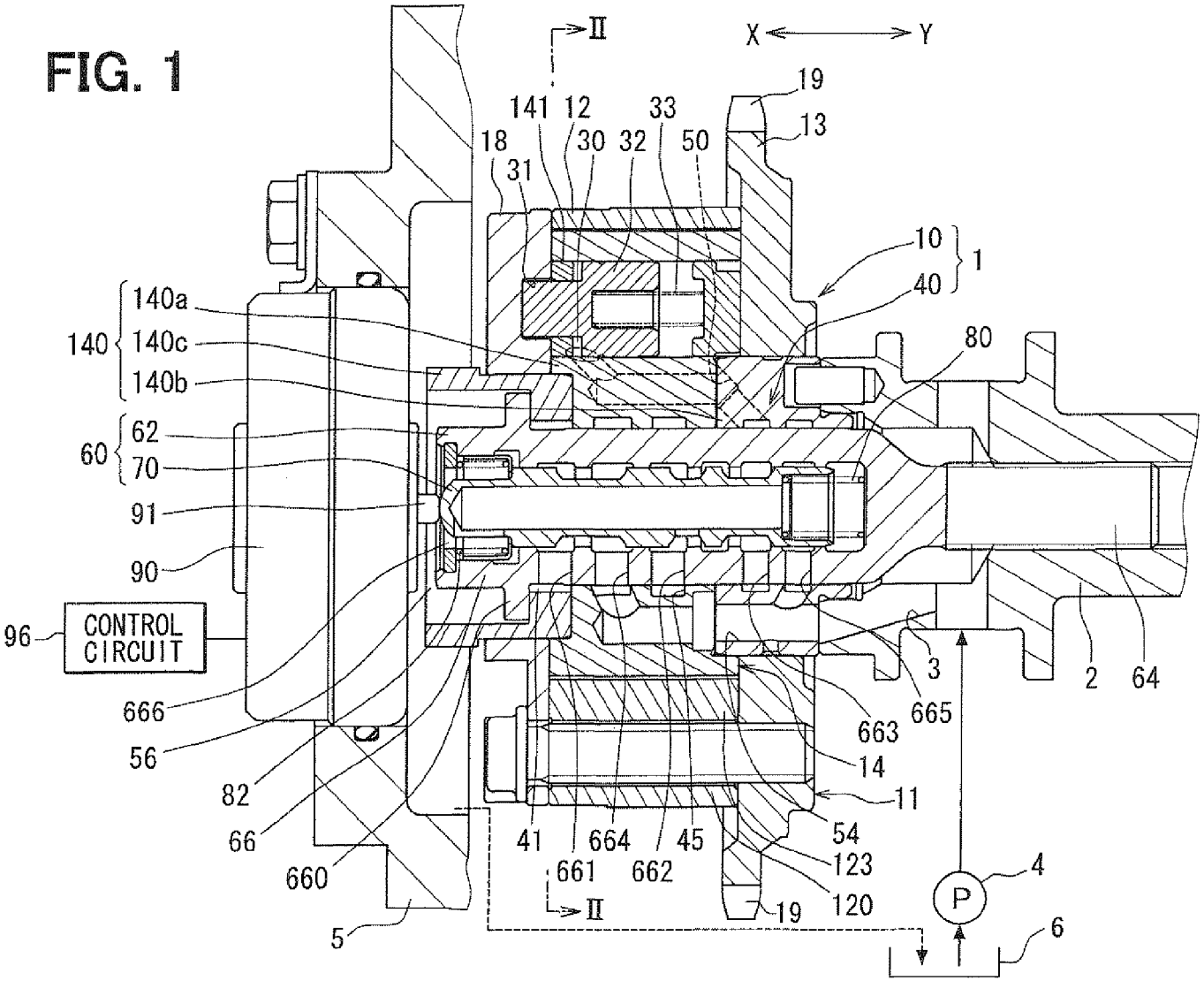
FIG. 1 is a cross sectional view showing a valve timing controller according to a first embodiment of the present invention, taken along a line I-I in FIG. 2.

Hereafter, a plurality of embodiments of the present invention are described. In each embodiment, the same parts and the components are indicated with the same reference numeral and the same description will not be reiterated.

[First Embodiment]

FIG. 1 shows a first embodiment of a valve timing controller 1 which is applied to an internal combustion engine for a vehicle. The valve timing controller 1 adjusts a valve timing of an intake valve which is driven by a camshaft 2 with hydraulic oil as "hydraulic fluid". The valve timing adjusting apparatus 1 includes a drive unit 10 and a control unit 40. The drive unit 10 is provided in a driving torque transmission system and is driven with hydraulic oil. The driving torque transmission system transmits a driving torque of a crankshaft (not shown) of an internal combustion engine to a camshaft 2 of the internal combustion engine. The control unit 40 controls supply of hydraulic oil to the drive unit 10.

(Drive Unit)

A configuration of a drive unit 10 will be described in detail. A housing 11 of the drive unit 10 is comprised of a shoe housing 12, a sprocket 13, a front plate 18 and the like.

The shoe housing 12 made of metal includes a cylindrical housing body 120 and a plurality of shoes 121, 122, 123 as dividing portions. Each of the shoes 121, 122, 123 is circumferentially arranged one after another at generally equal intervals on an inner surface of the housing body 120 and radially inwardly projects therefrom. An inner end of each of the shoes 121-123 is formed in arc-shape and slides on an outer surface of a rotary shaft 140 of a vane rotor 14. Also, multiple receiving chambers 20 are defined between the adjacent shoes 121-123 that are arranged circumferentially in a rotational direction.

The sprocket 13 and the front plate 18 are annular plates made of metal and are coaxially fixed to both ends of the shoe housing 12. The sprocket 13 has a plurality of gear teeth 19 which are mechanically engaged with the crank shaft through a timing chain (not shown). During an operation of the internal combustion engine, a driving torque is transmitted from the crankshaft to the sprocket 13 such that the housing 11 rotates in a clockwise direction in FIG. 2 together with the crankshaft.

A vane rotor 14 made of metal is coaxially accommodated in the housing 11. Both side surfaces of the vane rotor 14 are slidably in contact with the sprocket 13 and the front plate 18. The vane rotor 14 includes the rotary shaft 140 and three vanes 14*b*, 14*c*, 14*d*.

The rotary shaft 140 is coaxially connected to the camshaft 2. Thus, the vane rotor 14 rotates in the clockwise direction in FIG. 2 together with the camshaft 2, and rotates relative to the housing 11. In the present embodiment, the rotary shaft 140 is comprised of a shaft body 140*a*, a boss 140*b*, and a bush 140*c*. The boss 140*b* axially penetrates the sprocket 13 to be connected to the camshaft 12. The bush 140*c* axially penetrates the front plate 18 to be opened outside of the housing 11. Each of the vanes 141, 142, 143 protrudes radially outwardly from the shaft body 140*a* at regular intervals and is accommodated in the corresponding receiving chamber 20 respectively. A top end of each vane 141-143 is formed in arc-shape and is slidably in contact with an inner surface of the housing body 120.

Each of the vanes 141-143 divides the corresponding receiving chamber 20 into two chambers that are arranged one after another in the rotational direction such that each of the vanes 141-143 and the housing 11 define an advance chamber 22, 23, 24 and a retard chamber 26, 27, 28 serving as hydraulic chambers. Specifically, an advance chamber 22 is defined between the shoe 121 and the vane 141, an advance chamber 23 is defined between the shoe 122 and the vane 142, and an advance chamber 24 is defined between the shoe 123 and the vane 143, respectively. When the hydraulic oil is introduced into the advance chambers 22-24, their volumes are increased, so that the vanes 141-143 are biased in an advance direction relative to the shoes 121-123. Furthermore, a retard chamber 26 is defined between the shoe 122 and the vane 141, a retard chamber 27 is defined between the shoe 123 and the vane 142, and a retard chamber 28 is defined between the shoe 121 and the vane 143, respectively. When the hydraulic oil is introduced into the retard chambers 26-28, their volumes are increased, so that the vanes 141-143 are biased in a retard direction relative to the shoes 121-123.

A lock chamber 30 of cylindrical hole shape is formed in the vane 141, and the concave circular lock hole 31 is formed in the front plate 18 which the vane 141 is slidably in contact with. Furthermore, the vane 141 has a columnar metallic lock pin 32 of which end portion confronts the lock chamber 30, and a metallic lock spring 33 which biases the lock pin 32 toward the front plate 18.

Figure 3:
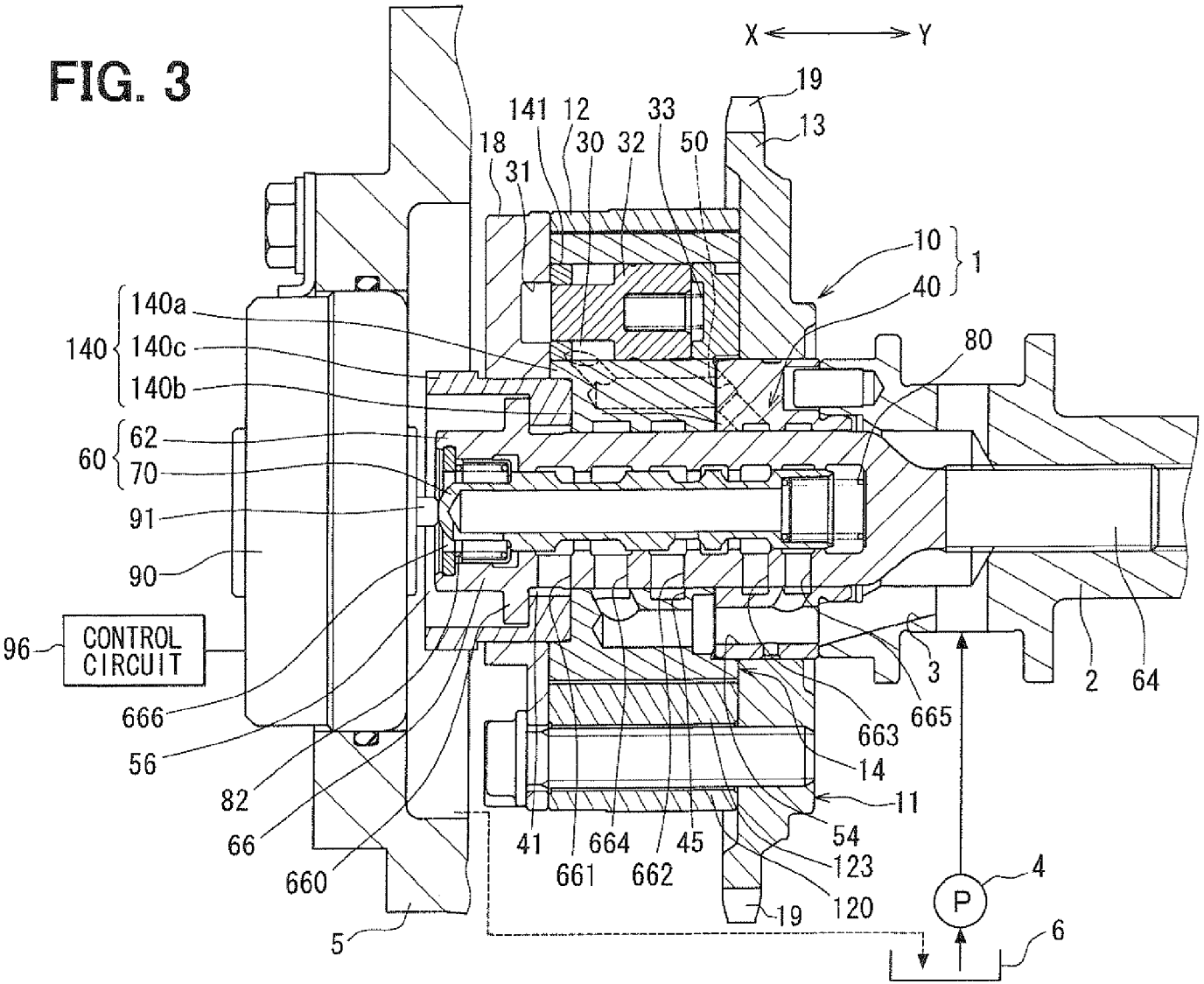
FIG. 3 is a cross sectional view for explaining an actuation of the drive unit.

When the hydraulic oil is discharged from the lock chamber 30, the lock pin 32 is displaced by a restoring force of the lock spring 33 and is fitted with the lock hole 31, as shown in FIG. 1, such that the vane rotor 14 is locked relative to the housing 11. A rotational phase of the locked vane rotor 14 relative to the housing 11 is determined according to engine specifications. In the present embodiment, the rotational phase of the locked vane rotor 14 is a middle phase between the most advanced phase and the most retarded phase. On the other hand, when the hydraulic oil is introduced into the lock chamber 30, the lock pin 32 is displaced against the restoring force of the lock spring 33, as shown in FIG. 3, so that the lock pin 32 is disengaged from the lock hole 31 to release the vane rotor 14. In the present embodiment, the lock chamber 30, the lock hole 31, the lock pin 32, and the lock spring 33 function as a lock means of the present invention.

As described above, when the lock pin 32 is engaged with the lock hole 31, the rotational phase of the vane rotor 14 relative to the housing 11 is hold. On the other hand, when the lock pin 32 is disengaged from the lock hole 31, the hydraulic oil is introduced into the advance chambers 22-24 and the hydraulic oil in the retard chambers 26-28 is discharged, the vane rotor 14 rotates in the advance direction to advance the valve timing. Besides, when the hydraulic oil is introduced into the retard chambers 26-28 and the hydraulic oil in the advance chambers 22-24 is discharged, the vane rotor 14 rotates in the retard direction to retard the valve timing.

(Control Unit)

Figure 2:
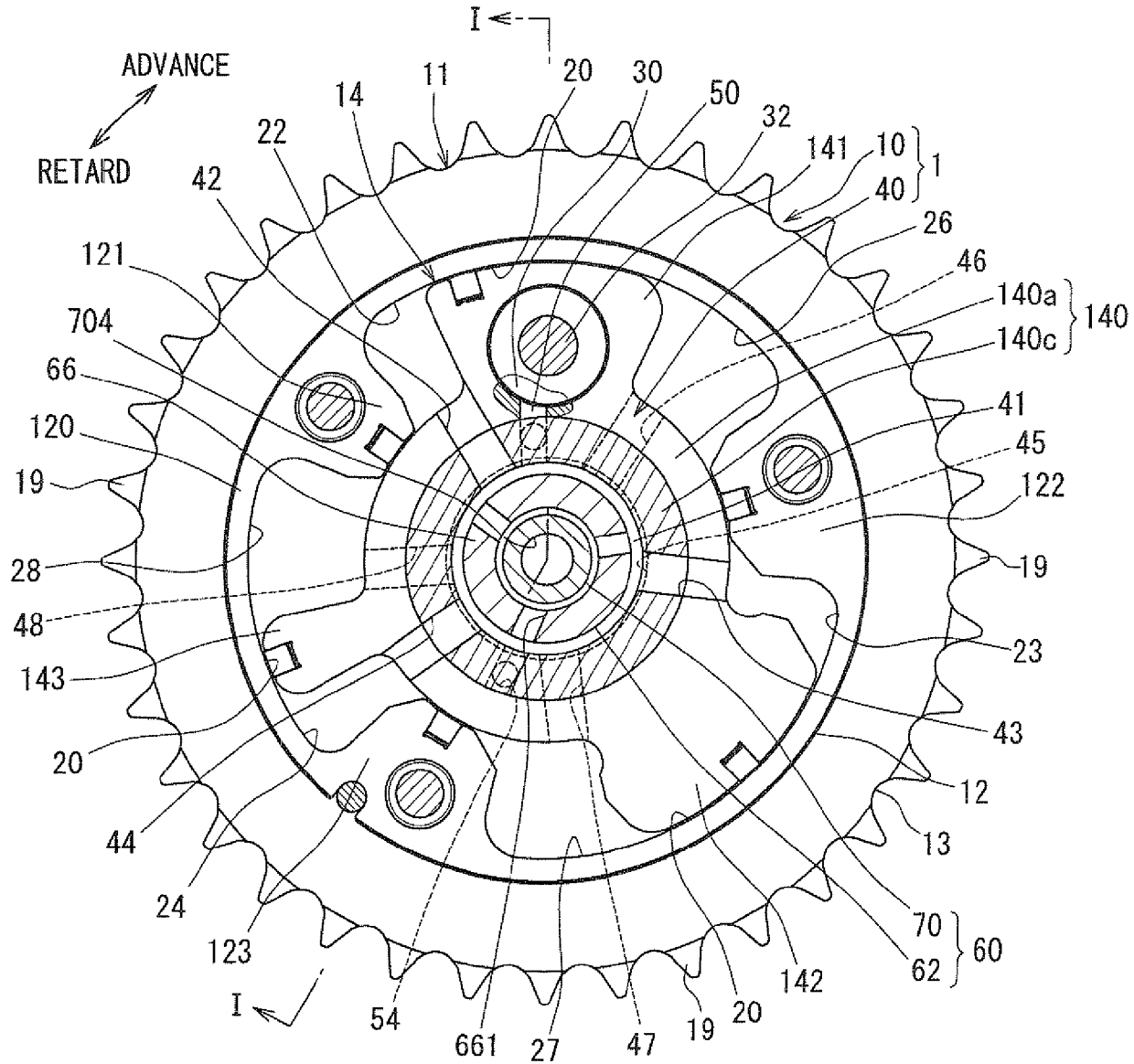
FIG. 2 is a cross sectional view showing a drive unit, taken along a line II-II in FIG. 1.

A configuration of the control unit 40 will be described in detail. As shown in FIGS. 1 and 2, a main advance passage 41 is formed along an inner periphery of the bush 140*c*. Branch advance passages 42, 43, 44 penetrate the shaft body 140*a* and the bush 140*c*. Each of the branch advance passages 42, 43, 44 is fluidly communicated to respectively corresponding advance chamber 22-24 and the main advance passage 41. A main retard passage 45 is formed by an annular groove opening at inner periphery of the shaft body 140*a*. Branch retard passages 46, 47, 48 penetrate the shaft body 140*a*. Each of the branch retard passages 46, 47, 48 is fluidly communicated with respectively corresponding retard chamber 26-28 and the main retard passage 45. A lock passage 50 penetrates the shaft body 140*a* and the boss 140*b* to communicate with the lock chamber 30.

A supply passage 54 penetrates the shaft body 140*a* and the boss 140*b* to communicate with a pump 4 through a feed passage 3 formed in the camshaft 2. The pump 4 is a supply source of the hydraulic oil. The pump 4 is a mechanical pump driven by the internal combustion engine through the crankshaft. While the engine is operated, the pump 4 pumps up the hydraulic oil from the oil pan 6 and continuously discharges the hydraulic oil to the feed passage 3. Moreover, the feed passage 3 always communicates with a discharge port of the pump 4 without respect to the rotation of the camshaft 2. Thus, while the engine is operated, the hydraulic oil discharged from the pump 4 is continuously introduced into the supply passage 54.

A discharge passage 56 is defined by an opening of the bush 140*c* and an inner wall of a chain cover 5 accommodating the housing 11. The hydraulic oil in the valve timing controller 1 can be discharged to the oil pan 6 through the discharge passage 56 and an interior of the chain cover 5.

A control valve 60 is a spool valve comprised of a valve body 62 and a spool 70. The spool 70 is slidably inserted in the valve body 62 and functions as a valve member. The control valve 60 is coaxially disposed inside of the rotary shaft 140 in such a manner as to be rotated together.

The valve body 62 made of metal has a fixing portion 64 of external thread-shape and a cylindrical sleeve 66 in its axial direction. The fixing portion 64 is screwed to the camshaft 2, so that the shaft body 140*a*, the boss 140*b*, and the bush 140*c* are sandwiched between a flange 660 of the sleeve 66 and the camshaft 2. The sleeve 66 extends along the shaft body 140*a*, the boss 140*b*, and the bush 140*c*. The sleeve 66 opens inside of the bush 140*c*.

The sleeve 66 has five ports 661, 662, 663, 664, 665 which penetrate the sleeve 66 in a radial direction thereof at specified intervals in its axial direction. An advance port 661, which is formed most apart from the fixing portion 64, communicates with the main advance passage 41 as an operation port. A retard port 662 positioned closer to the fixing portion 64 than the advance port 661 communicates with the main retard passage 45. A lock port 663 adjacent to the retard port 662 communicates with the lock passage 50. A main supply port 664 positioned between the advance port 661 and the retard port 662 communicates with the supply passage 54. Also, a sub-supply port 665 adjacent to the lock port 663 communicates with the supply passage 54. Furthermore, the sleeve 66 has a discharge port 666 communicating with the discharge passage 56.

The spool 70 made of metal is cylindrically-shaped. One end of the spool 70 is closed and the other end of the spool 70 is opened. The spool 70 is coaxially arranged in the sleeve 66 in such a manner that the opening end confronts the fixing portion 64. The spool 70 can axially slide in the sleeve 66. In the present embodiment, an axial moving direction of the spool 70 toward the exhaust port 666 is defined as a first direction "X", and an axial moving direction of the spool 70 toward the fixing portion 64 is defined as a second direction "Y".

Figure 4:
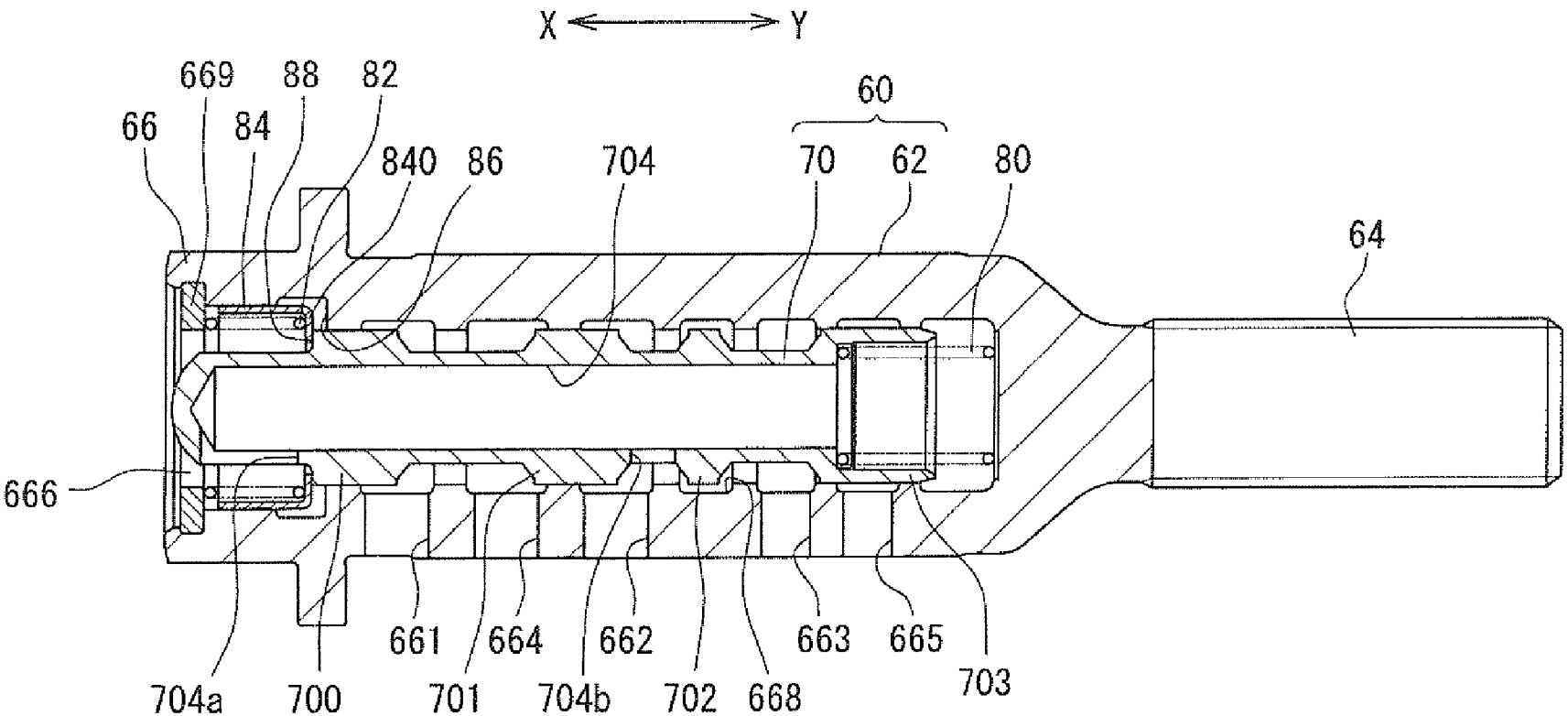
FIG. 4 is an enlarged cross sectional view showing an essential part of the control unit.

As shown in FIGS. 4-7, the spool 70 has four annular lands 700, 701, 702, 703 at specified intervals in its axial direction. An advance land 700, which is formed most apart from the fixing portion 64, is supported by a part of the sleeve 66 between the advance port 661 and the discharge port 666 and/or a part of the sleeve 66 between the advance port 661 and the main supply port 664, according to an axial position of the spool 70. A retard land 701, which is adjacent to the advance land 700, is supported by a part of the sleeve 66 between the retard port 662 and the main supply port 664 and/or a part of the sleeve 66 between the retard port 662 and the lock port 663, according to the axial position of the spool 70. A first lock land 702, which is adjacent to the retard land 701, is supported by a part of the sleeve 66 between the lock port 663 and the retard port 662, according to the axial position of the spool 70. However, it should be noted that the first lock land 702 may be unsupported by the sleeve 66 due to an annular groove 668 formed on an inner peripheral surface of the sleeve 66, as shown in FIG. 4. A second lock land 703, which is adjacent to the first lock land 702, is supported by a part of the sleeve 66 between the sub-supply port 665 and the lock port 663, according to the axial position of the spool 70. Further, the second lock land 703 is always supported by a part of the sleeve 66 between the sub-supply port 665 and the fixing portion 64 without respect to the axial position of the spool 70.

As shown in FIGS. 2 and 4, the spool 70 defines a communication passage 704 therein. The spool 70 has a first opening 704*a* adjacent to the closed end of the spool 70. The communication passage 704 always communicates with the discharge port 666 through the first opening 704*a* without respect to the axial position of the spool 70. Furthermore, the spool 70 has a second opening 704*b* between the retard land 701 and the first lock land 702. The communication passage 704 communicates with the retard port 662 or the lock port 663 through the second opening 704*b*, according to the axial position of the spool 70.

Figure 8:
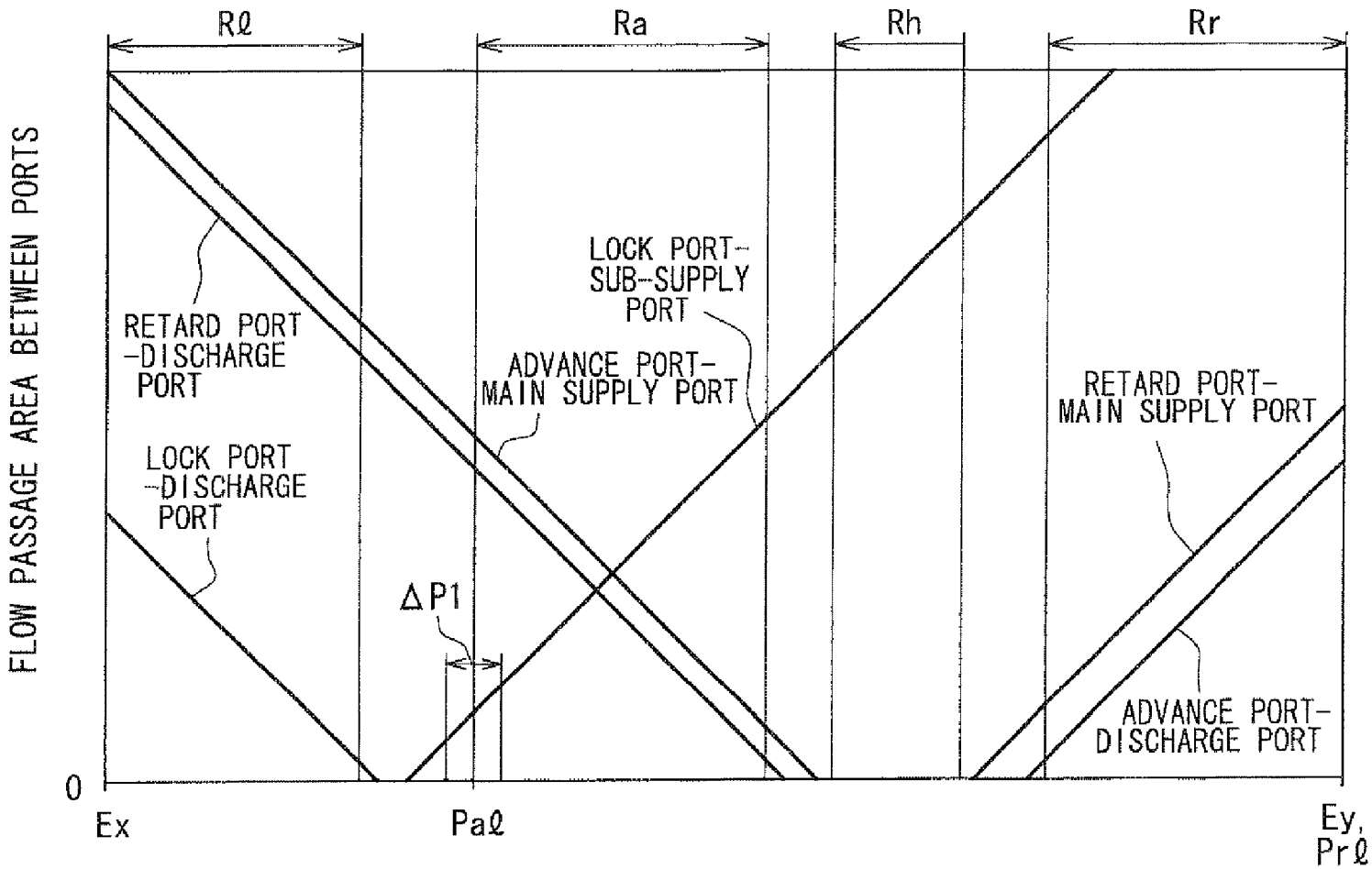
FIG. 8 is a characteristics chart for explaining an actuation of a control unit shown in FIG. 1.

According to the above configuration, when the spool 70 is positioned in a lock range RI including a stroke end "Ex" in the first direction "X", which is shown in FIG. 8, the advance port 661 is fluidly connected to the main supply port 664 between the advance land 700 and the retard land 701 as shown in FIG. 4. Moreover, the retard port 662 fluidly connected to the lock port 663 through the annular groove 668 is further connected with the discharge port 666 through the communication passage 704. Further, as shown in FIG. 4, when the spool is 70 is positioned in the lock range RI, the sub-supply port 665 is fluidly disconnected from the other ports.

Figure 5:
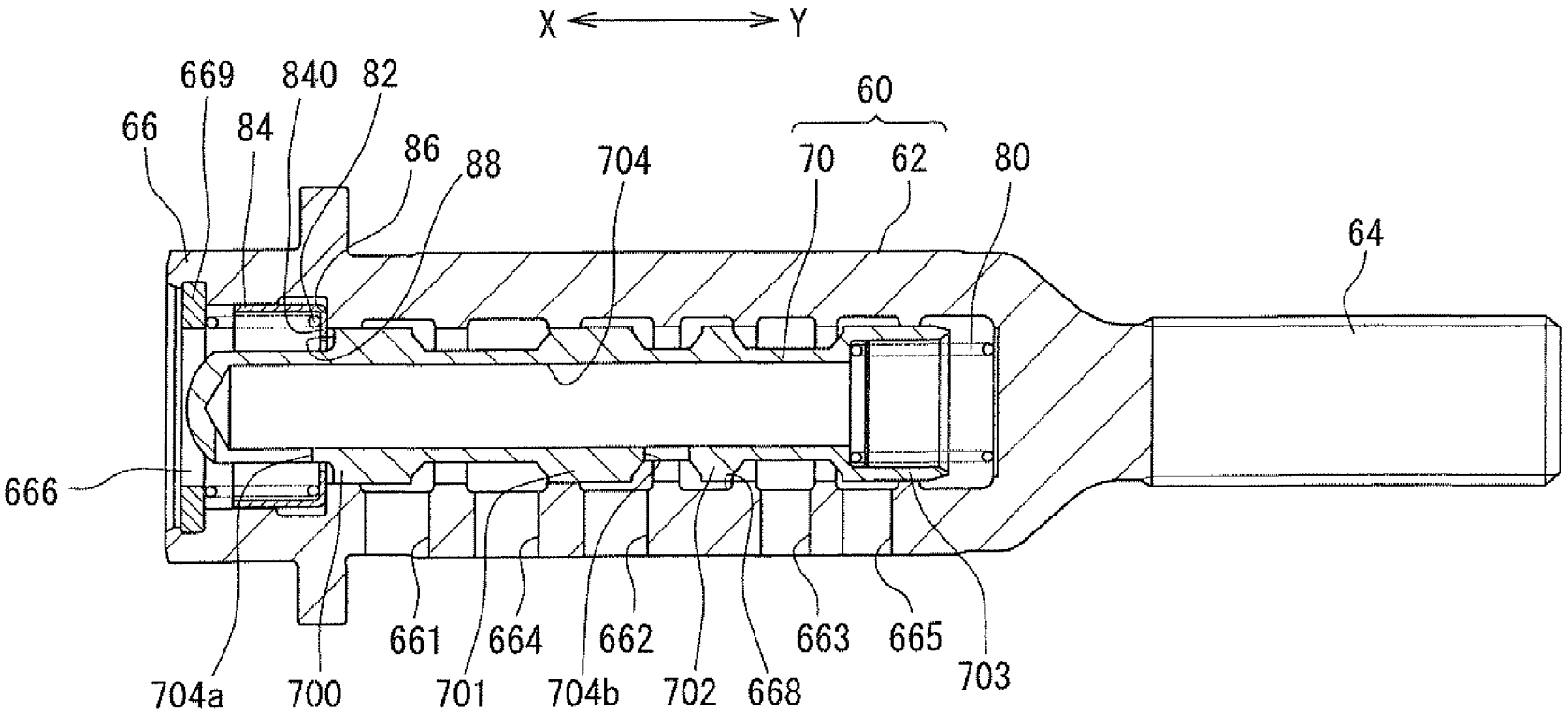
FIG. 5 is an enlarge cross sectional view showing the essential part of the control unit.

When the spool 70 moves in the second direction "Y" to be positioned in an advance range Ra shown in FIG. 8, which corresponds to a stroke range deviating from the lock range RI in the second direction "Y", the advance port 661 is fluidly connected to the main supply port 664 between the advance land 700 and the retard land 701 as shown in FIG. 5. It should be noted that a flow passage area between the advance port 661 and the main supply port 664 which defines a flow rate of the hydraulic oil (an opening area of the advance port 661) is smaller than that in the lock range RI. At a limit position Pal, the flow passage area is maximum in the advance range Ra, as shown in FIG. 8. Moreover, as shown in FIG. 5, the retard port 662 is fluidly connected to the communication passage 704 between the retard land 701 and the first lock land 702 to be connected with the discharge port 666 through the communication passage 704. The lock port 663 is fluidly connected to the sub-supply port 665 between the first lock land 702 and the second lock land 703, and is fluidly connected to the main supply port 664 through the supply passage 54 (refer to FIG. 1) which communicates with the sub-supply port 665.

Figure 6:
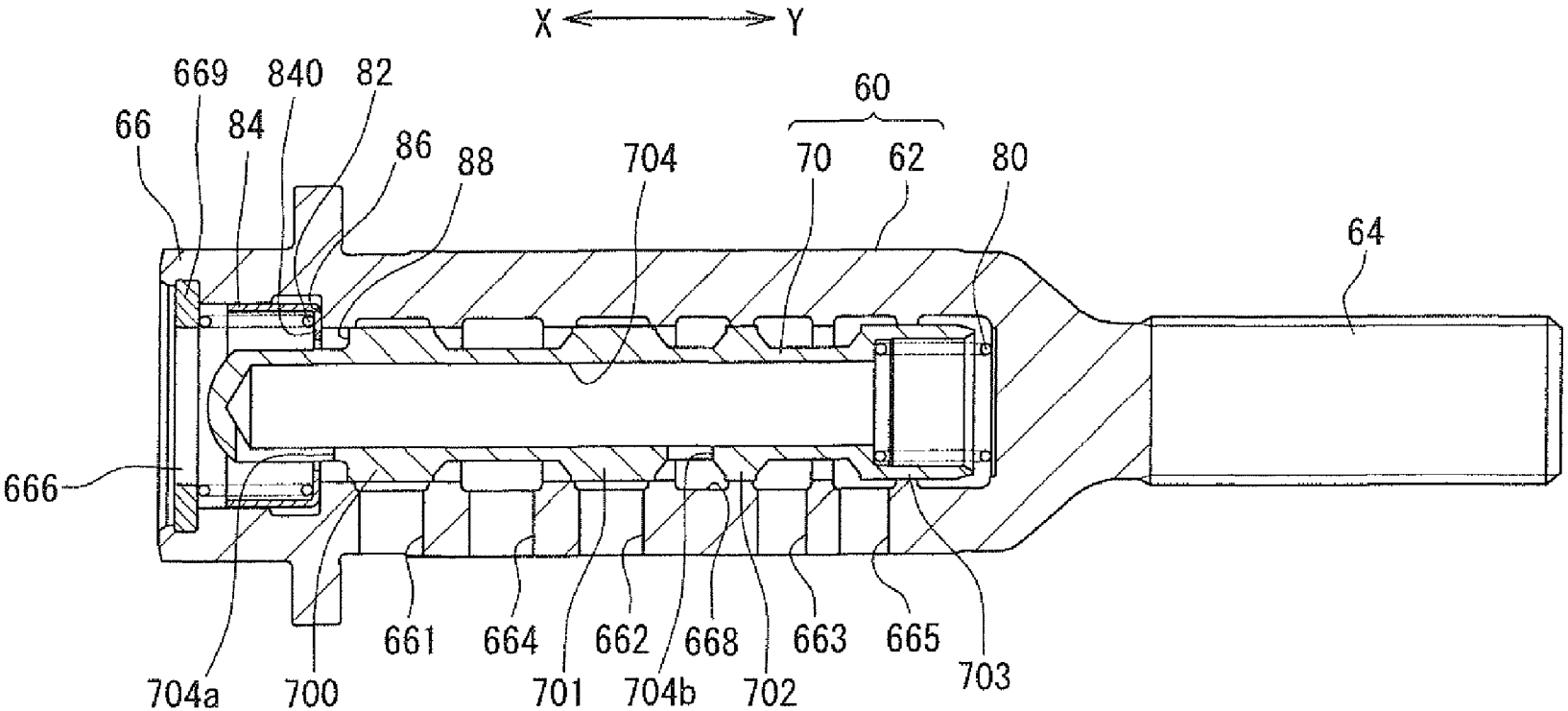
FIG. 6 is an enlarge cross sectional view showing the essential part of the control unit.

When the spool 70 further moves from the advance range Ra in the second direction "Y" to be positioned in a hold range Rh shown in FIG. 8, the advance port 661 is fluidly disconnected from the other ports as shown in FIG. 6. Further, the retard port 662 is fluidly disconnected from the other ports. The lock port 663 is fluidly connected to the sub-supply port 665 between the first lock land 702 and the second lock land 703, and is fluidly connected to the main supply port 664 through the supply passage 54.

Figure 7:
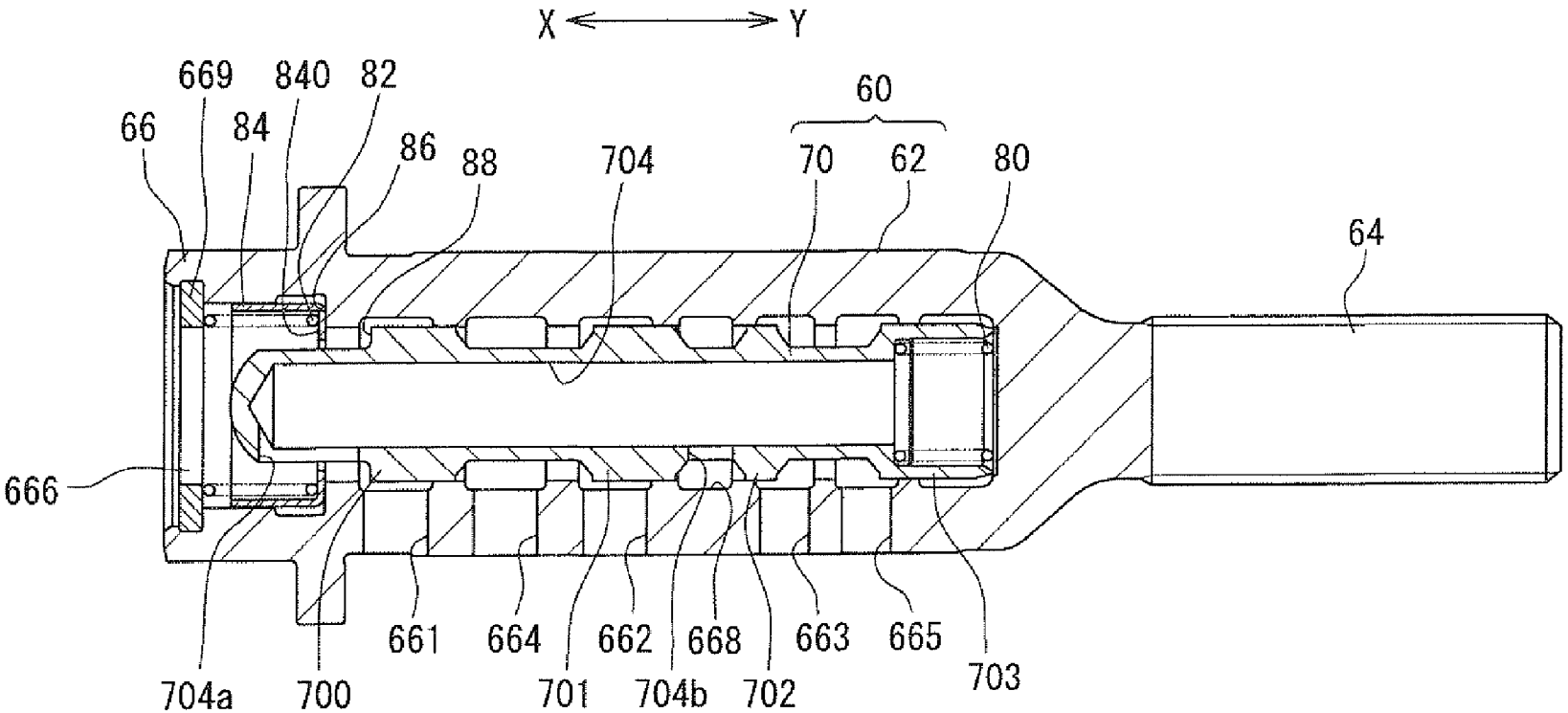
FIG. 7 is an enlarge cross sectional view showing the essential part of the control unit.

When the spool 70 moves from the hold range Rh in the second direction "Y" to be positioned in a retard range Rr shown in FIG. 8, the advance port 661 is fluidly connected to the discharge port 666 as shown in FIG. 7. The retard port 662 is fluidly connected to the main supply port 664. The lock port 663 is fluidly connected to the sub-supply port 665 between the first lock land 702 and the second lock land 703, and is fluidly connected to the main supply port 664 through the supply passage 54.

As shown in FIGS. 1 and 4, the control unit 40 is provided with a first elastic member 80, a second elastic member 82, a movable retainer 84, stoppers 86, 88, a driving source 90, and a control circuit 96.

As shown in FIG. 4, the first elastic member 80 is a coil spring made of metal, which is coaxially disposed in the control valve 60 between a bottom of the sleeve 66 and the second lock land 73. The first elastic member 80 generates a first restoring force biasing the spool 70 in the first direction "X".

The second elastic member 82 is a coil spring made of metal, which is coaxially disposed in the control valve 60 between a washer 669 and a movable retainer 84. The second elastic member 82 generates a second restoring force biasing the movable retainer 84 in the second direction "Y".

The movable retainer 84 made of metal is cylindrically shaped and is coaxially disposed in such a manner as to axially move in the discharge port 666 of the sleeve 66. The movable retainer 84 has a flange portion 840 which supports one end of the second elastic member 82. The flange portion 840 is engaged with one of a stationary stopper 86 formed on the inner periphery wall of the sleeve 66 and a movable stopper 88 formed by the advance land 700, according to the axial position of the spool 70.

Figure 9:
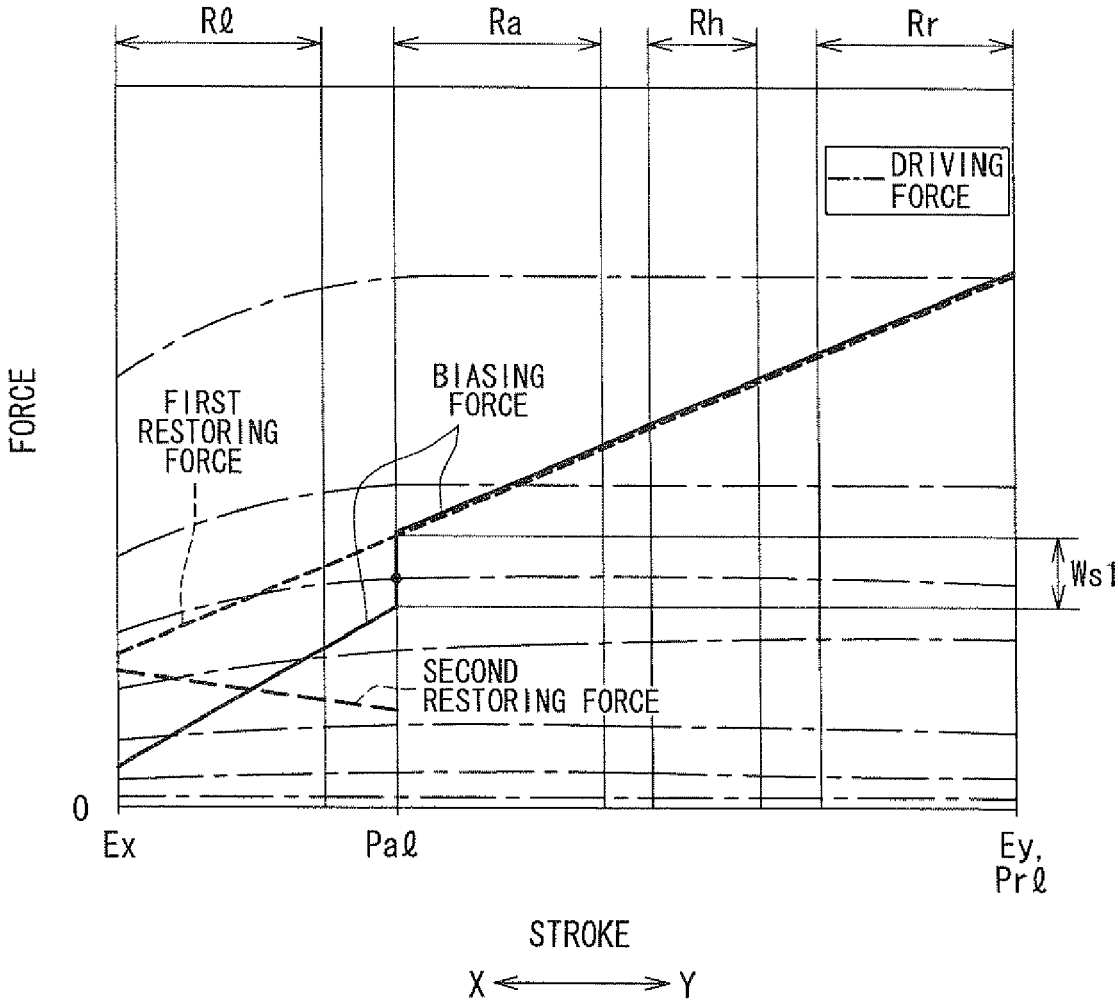
FIG. 9 is a characteristics chart for explaining an actuation of the control unit shown in FIG. 1.

When the spool 70 is positioned in the lock range RI as shown in FIG. 4, the movable retainer 84 is engaged with the movable stopper 88 and disengaged from the stationary stopper 86. Thereby, the spool 70 is biased by both of the first restoring force of the first elastic member 80 and the second restoring force of the second elastic member 82. As shown in FIG. 9, in the lock range RI, the second restoring force is less than the first restoring force at any axial position of the spool 70. Therefore, in the lock range RI, the resultant force of the first restoring force and the second restoring force biases the spool 70 in the first direction "X".

When the spool 70 is positioned in the advance range Ra as shown in FIG. 5, the hold range Rh as shown in FIG. 6, or the retard range Rr as shown in FIG. 7, the movable retainer 84 is engaged with the stationary stopper 86 and disengaged from the movable stopper 88. Thereby, the spool 70 is biased by only the first restoring force of the first elastic member 80. Therefore, as shown in FIG. 9, in the advance range Ra, the hold range Rh, and the retard range Rr, the first restoring force only biases the spool 70 in the first direction "X".

Figure 10:
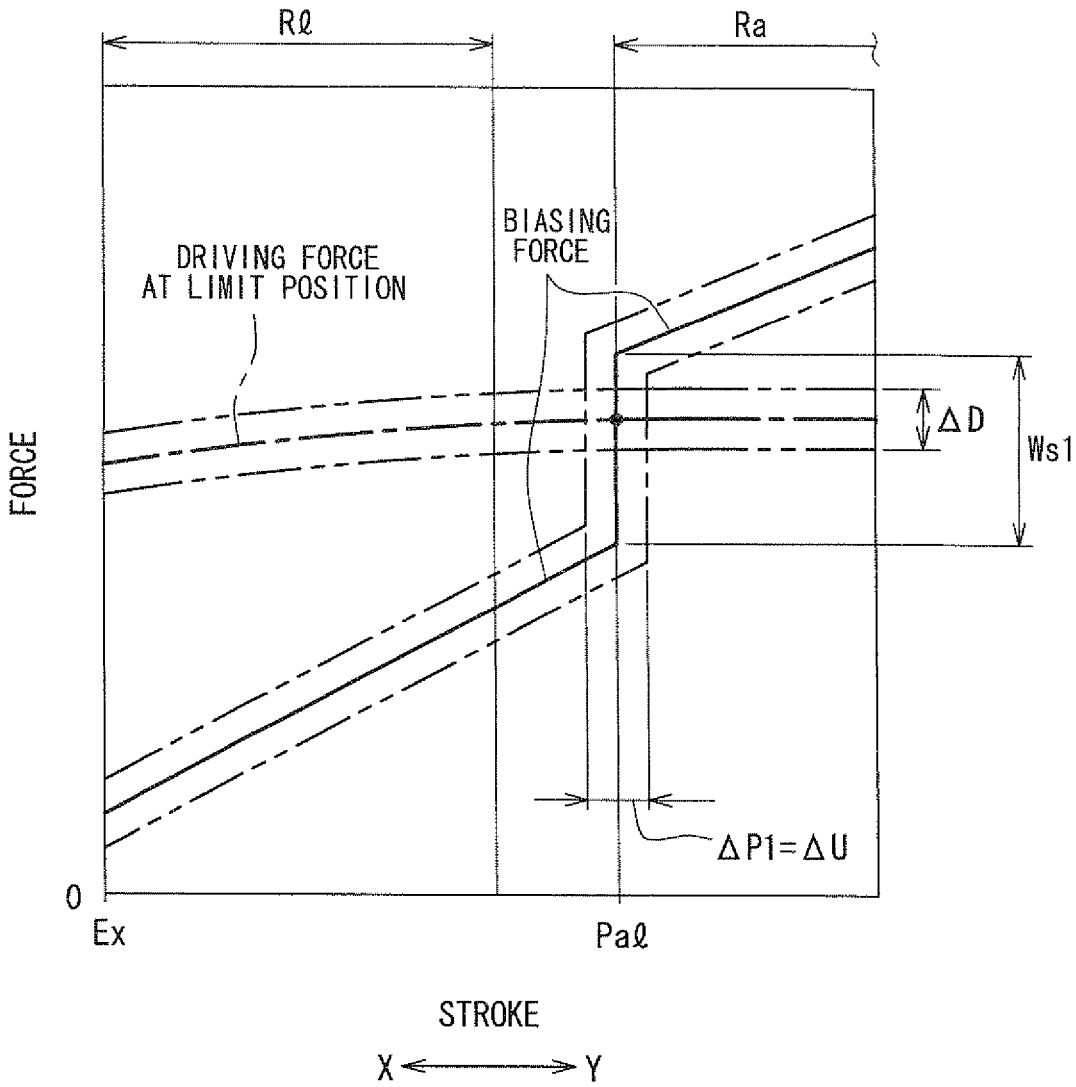
FIG. 10 is a characteristics chart for explaining an actuation of the control unit shown in FIG. 1.

According to the present embodiment, when the spool 70 is positioned at a limit position Pal of the advance range Ra, the biasing force biasing the spool 70 in the first direction "X" is stepwise varied by a specified variation width Ws1, as shown in FIG. 9. As shown in FIG. 10, the specified variation width Ws1 is set greater than an estimated value of an individual product variation ΔD in driving force generated by the driving source 90 which moves the spool 70 to the limit position Pal. In the present embodiment, the first elastic member 80, the second elastic member 82, the movable retainer 84, the stationary stopper 86, and the movable stopper 88 function as a biasing means. The movable retainer 84, the stationary stopper 86, and the movable stopper 88 function as a setting means.

The driving source 90 is an electromagnetic solenoid having a driving shaft 91, which is supported by the chain cover 5. The driving shaft 91 moves in either of the first direction "X" and the second direction "Y". The end of the driving shaft 91 is always in contact with the closed end of the spool 70 by a biasing force in the first direction "X". Therefore, when the solenoid (not shown) of the driving source 90 is energized, a driving force is generated to move the spool 70 in the second direction "Y" through the driving shaft 91. This driving force is represented by dashed lines in FIG. 9. The spool 70 moves to a position where the driving force in the second direction "Y" generated by the driving source 90 is equal to the biasing force in the first direction "X". This position is represented by an intersection point of the dashed line and a solid line in FIG. 9.

The control circuit 96 includes, for example, a microcomputer, and is electrically connected with the solenoid coif of the driving source 90. The control circuit 96 controls an operation of the control valve 60 by energizing the solenoid of the driving source 90, and controls an operation of the internal combustion engine.

(Operation of Controller)

Next, an operation of the valve timing controller 1 will be explained in detail.

(1) Lock Operation

When the internal combustion engine is at stop state, starting state, or idling state, the pressure of hydraulic oil is relatively low. The control circuit 96 energizes the solenoid of the driving source 90 to drive the control valve 60, so that the spool 70 moves to be positioned in the lock range RI as shown in FIG. 4.

As a result, the advance port 661 communicating with each advance chamber 22-24 through the passages 41-44 is fluidly connected to the main supply port 664 communicating with the pump 4 through the supply passages 54 and the feed passage 3. The hydraulic oil supplied from the pump 4 is introduced into each advance chamber 22-24. Moreover, the retard port 662 communicating with each retard chamber 26-28 through the passages 45-48 is fluidly connected to the discharge port 666 communicating with the discharge passage 56 through the communication passage 704, so that the hydraulic oil in each retard chamber 26-28 is discharged. Moreover, the lock port 663 communicating with the lock chamber 30 through the lock passage 50 is fluidly connected to the discharge port 666 through the communication passage 704, so that the hydraulic oil in the lock chamber 30 is discharged.

As described above, when the spool 70 is in the lock range RI, the hydraulic oil is introduced into each of the advance chambers 22-24 and is discharged from each of the retard chambers 26-28. The hydraulic oil in the lock chamber 30 is discharged to engage the lock pin 32 with the lock hole 31, so that the vane rotor 14 is locked. Therefore, even if the pressure of the hydraulic oil is low, an excessive vibration of the vane rotor 14 in the housing 11 can be avoided to restrict a generation of noise. Especially, even when the internal combustion engine is at stop state in which the pump 4 and the driving source 90 are OFF, only a biasing force in the first direction "X" is applied to the spool 70, so that the lock of the vane rotor 14 is ensured.

(2) Advance Operation

When the internal combustion engine is at low-middle speed and high-load state where relatively high driving torque is necessary, the control circuit 96 energizes the solenoid of the driving source 90 to drive the control valve 60 so that the spool 70 moves to be positioned in the advance range Ra as shown in FIG. 5.

As a result, the advance port 661 is fluidly connected to the main supply port 664 to introduce the hydraulic oil supplied from the pump 4 into each of the advance chambers 22-24, and the retard port 662 is fluidly connected to the discharge port 666 to discharge the hydraulic oil from each of the retard chambers 26-28. The lock port 663 communicating with the lock chamber 30 is fluidly connected to the sub-supply port 665 and the main supply port 664, so that the hydraulic oil is introduced into the lock chamber 30.

As described above, when the spool 70 is in the advance range Ra, the hydraulic oil is introduced into the lock chamber 30 to disengage the lock pin 32 from the lock hole 31, the hydraulic oil is introduced into the each of the advance chambers 22-24 and is discharged from each of the retard chambers 26-28. Therefore, when the spool 70 moves to be positioned at the limit position Pal of the advance range Ra, the flow passage area between the advance port 661 and the main supply port 664 becomes maximum in the advance range Ra. The flow rate of the hydraulic oil becomes maximum in the advance range Ra, so that the valve timing can be advanced rapidly.

(3) Hold Operation

When the internal combustion engine is at stable state, the control circuit 96 energizes the solenoid of the driving source 90 to drive the control valve 60 so that the spool 70 moves to be positioned in the hold range Rh as shown in FIG. 6.

As a result, since the advance port 661 is disconnected from the other ports, the hydraulic oil in each of the advance chambers 22-24 is held therein. Moreover, since the retard port 662 is also disconnected from the other ports, the hydraulic oil in each of the retard chambers 26-28 is held therein. The lock port 663 is fluidly connected to the sub-supply port 665 and the main supply port 664, so that the hydraulic oil is introduced into the lock chamber 30.

As described above, when the spool 70 is in the advance range Ra, the lock pin 32 is disengaged from the lock hole 31 and the hydraulic oil in the advance chambers 22-24 and the retard chambers 26-28 is held therein. As a result, the valve timing can be substantially held.

(4) Retard Operation

When the internal combustion engine is at low-load state where relatively low driving torque is necessary, the control circuit 96 energizes the solenoid of the driving source 90 to drive the control valve 60 so that the spool 70 moves to be positioned in the retard range Rr as shown in FIG. 7.

As the result, the advance port 661 communicating with each advance chamber 22-24 through the passages 41-44 is fluidly connected to the discharge port 666 communicating with the discharge passage 56 through the communication passage 704, so that the hydraulic oil in each advance chamber 22-24 is discharged. Moreover, the retard port 662 communicating with each retard chamber 26-28 through the passages 45-48 is fluidly connected to the main supply port 664 communicating with the pump 4 through the supply passages 54 and the feed passage 3. The hydraulic oil supplied from the pump 4 is introduced into each retard chamber 26-28. The lock port 663 is fluidly connected to the sub-supply port 665 and the main supply port 664, so that the hydraulic oil is introduced into the lock chamber 30.

As described above, when the spool 70 is in the retard range Rr, the hydraulic oil is introduced into the lock chamber 30 to disengage the lock pin 32 from the lock hole 31, the hydraulic oil is introduced into the each of the retard chambers 26-28 and is discharged from each of the advance chambers 22-24. Therefore, when the spool 70 moves to be positioned at the limit position Prl of the retard range Rr, which corresponds to a stroke end "Ey" in the second direction "Y" as shown in FIG. 8, the flow passage area between the retard port 662 and the main supply port 664 becomes maximum in the retard range Rr. The flow rate of the hydraulic oil becomes maximum in the retard range Rr, so that the valve timing can be retarded rapidly.

As described above, according to the first embodiment, when the spool 70 is positioned at a limit position Pal of the advance range Ra, the biasing force biasing the spool 70 in the first direction "X" is stepwise varied as shown in FIGS. 9 and 10. Since the specified variation width Ws1 is greater than an estimated value of an individual product variation ΔD in driving force which applied to the spool 70 in the second direction "Y" as shown in FIG. 10, the driving force can be surely balanced with the biasing force within the specified variation width Ws1. Thus, a variation ΔP1 in the limit position Pal, which is defined by a balance between the biasing force in the first direction "x" and the driving force in the second direction "Y", depends on only individual product variation ΔU in the biasing force as shown in FIGS. 9 and 10.

Therefore, according to the first embodiment, without an overlap between the lock range RI and the advance range Ra, the lock range RI and the advance range Ra can be narrowed as long as the maximum flow rate performance is ensured at the limit position Pal of the advance range Ra, as shown in FIG. 8. That is, even if the widths of the lock range RI and the advance range Ra should be defined based on the individual product variation in characteristics of the control valve 60, the widths of the lock range RI and the advance range Ra can be narrowed sufficiently.

As mentioned above, according to the first embodiment, since the widths of the lock range RI and the advance range Ra are narrowed, the stroke of the spool 70 can be shortened so that the valve timing controller 1 can be downsized.

[Second Embodiment]

Figure 11:
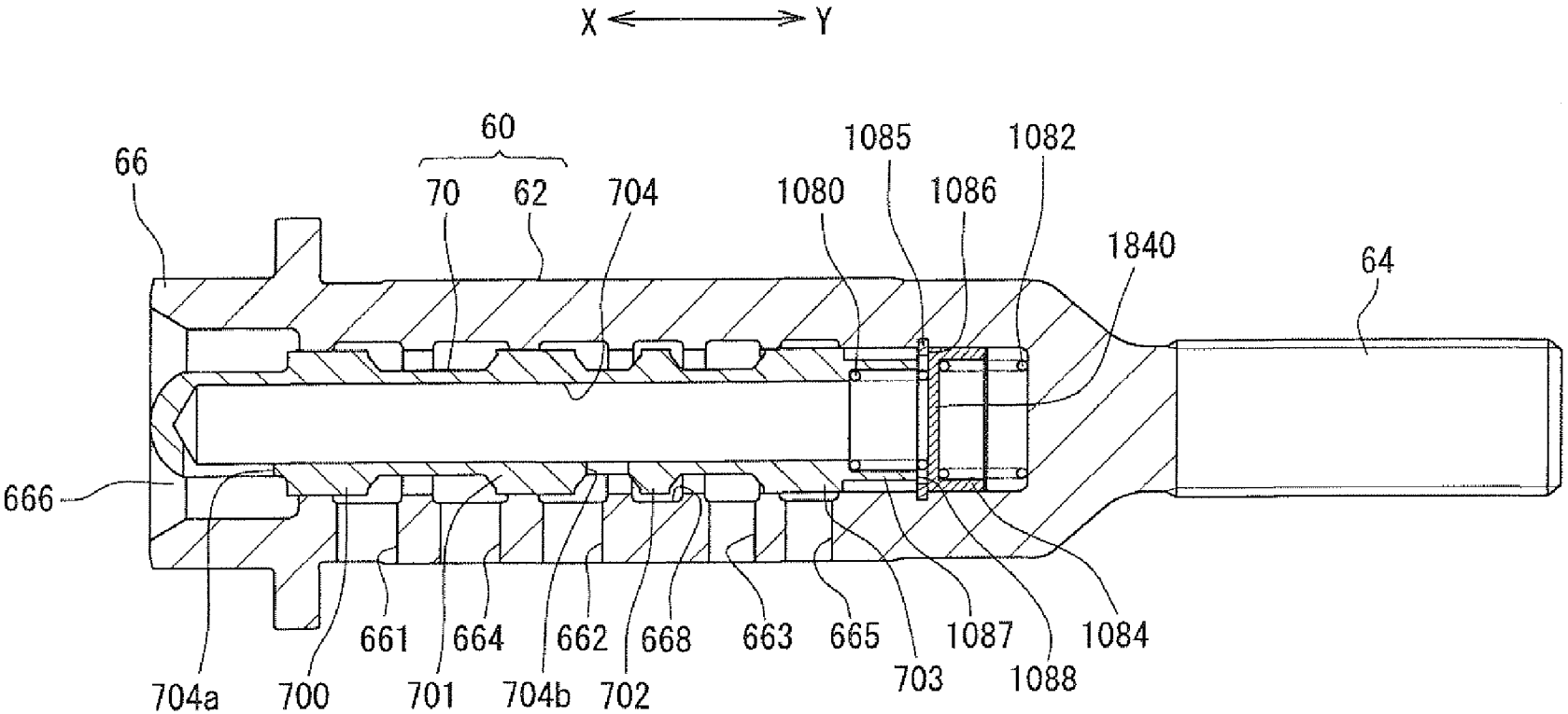
FIG. 11 is an enlarged cross sectional view showing an essential part of a control unit of a valve timing controller according to a second embodiment.

A second embodiment shown in FIGS. 11-15 is a modification of the first embodiment. The same parts and components as those in the first embodiment are indicated with the same reference numerals and the same descriptions will not be reiterated. As shown in FIG. 11, a control valve 60 includes a first elastic member 1080, a second elastic member 1082, a movable retainer 1084, a first stopper 1086, and a second stopper 1088.

The first elastic member 1080 is a coil spring made of metal, which is coaxially disposed in the spool 70 between a second lock land 703 and the movable retainer 1084. The first elastic member 1080 generates a first restoring force biasing the spool 70 and the movable retainer 1084 in the first direction "X" and the second direction "V".

Figure 15:
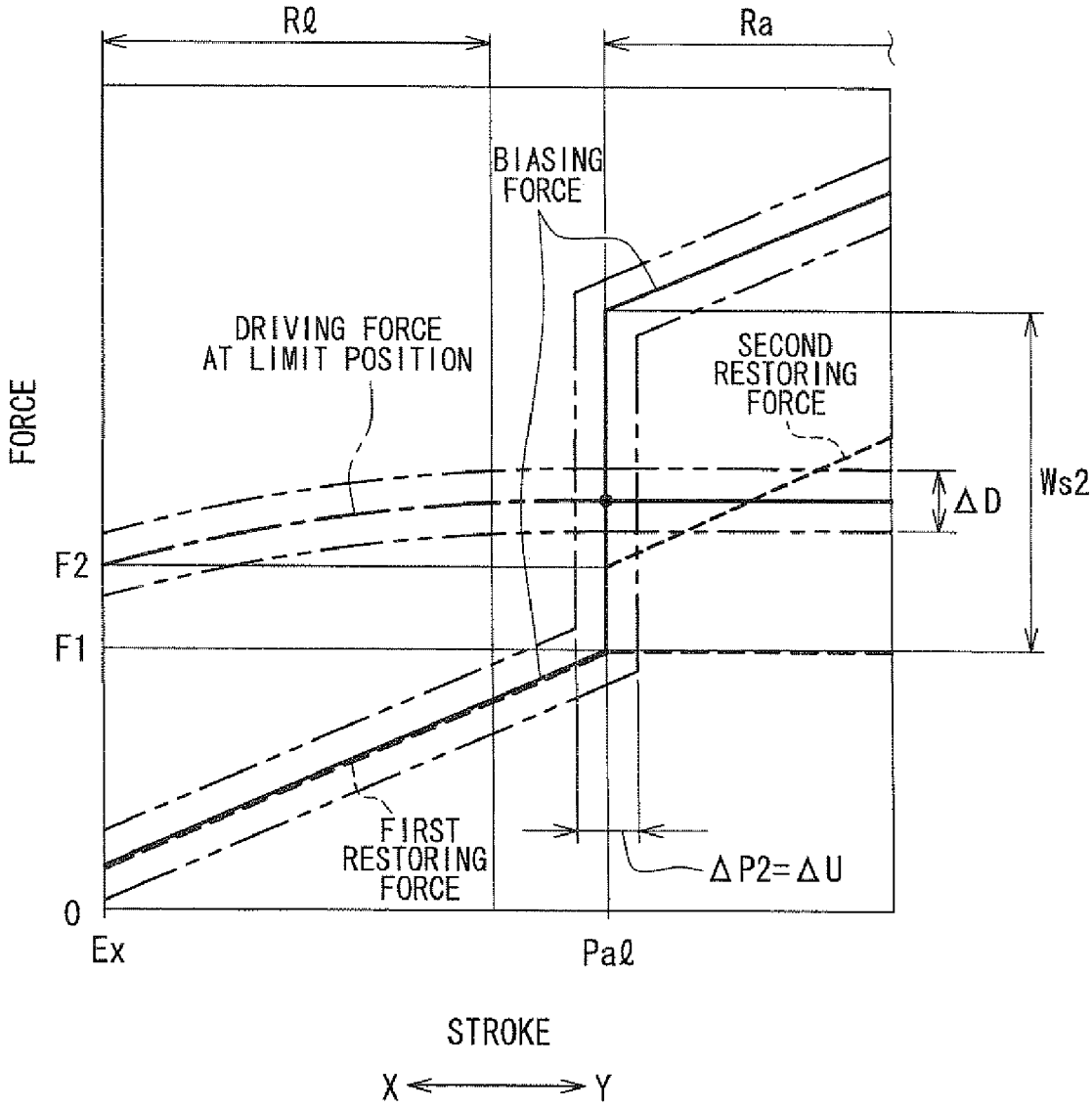
FIG. 15 is a characteristics chart for explaining an actuation of the control unit shown in FIG. 11.
Figure 16:
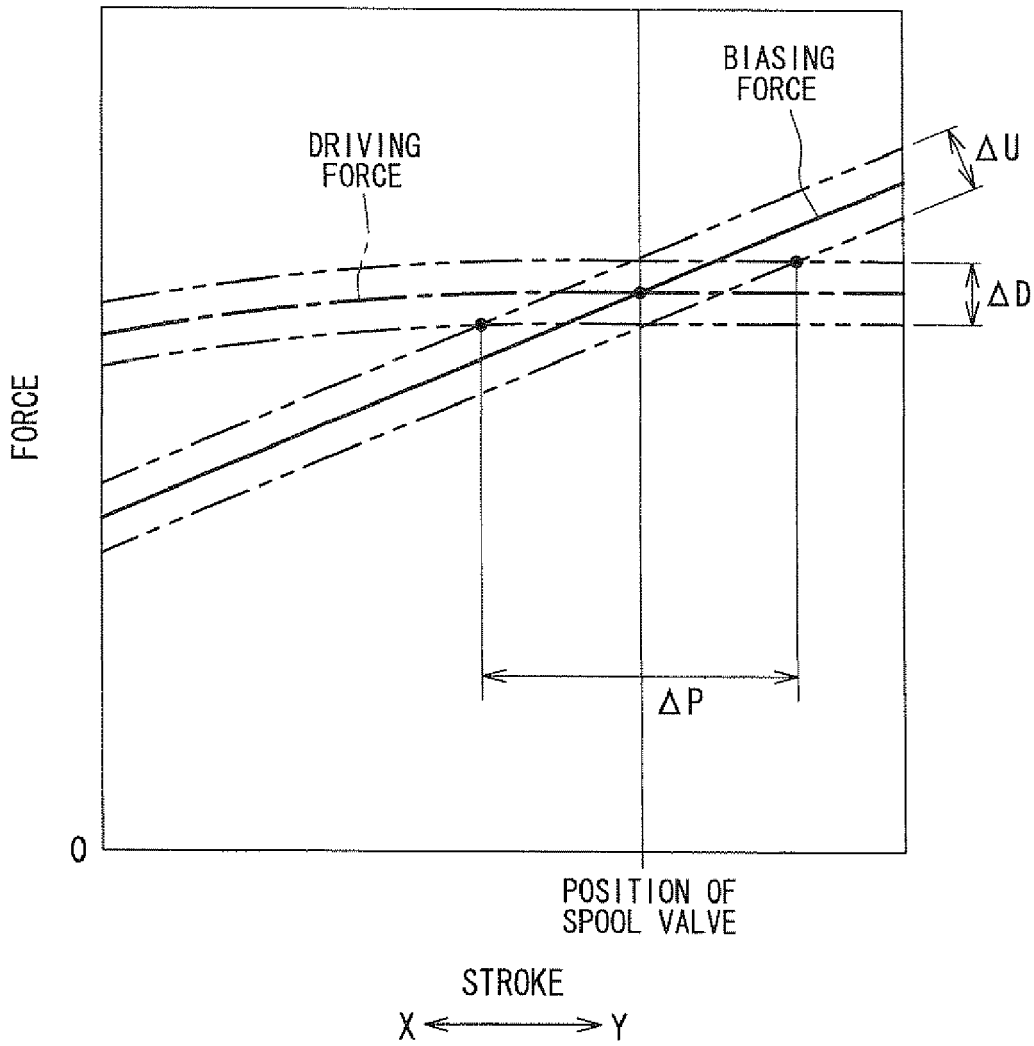
FIG. 16 PRIOR ART
FIG. 16 is a characteristics chart for explaining an actuation of a conventional valve timing controller.

The second elastic member 1082 is a coil spring made of metal, which is coaxially disposed in the control valve 60 between a bottom wall of the sleeve 66 and the movable retainer 1084. The second elastic member 1082 generates a second restoring force biasing the movable retainer 1084 in the first direction "X". As shown in FIG. 15, a set load F2 necessary for the second elastic member 1082 to be elastically deformed from its natural length is set larger than a maximum value F1 of the first restoring force which is applied to the spool 70 in the lock range RI.

The movable retainer 1084 made of metal is cylindrically shaped and is coaxially disposed in the sleeve 66 in such a manner as to axially move. The movable retainer 1084 has a flange portion 1840 which supports one end of the first elastic member 1080. The flange portion 1840 is engaged with one of a stationary stopper 1086 formed by a stopper ring 1085 and a movable stopper 1088 formed by a protruding portion 1087 of the spool 70, according to the axial position of the spool 70. Furthermore, the flange portion 1840 supports one end of the second elastic member 1082.

When the spool 70 is positioned in the lock range RI as shown in FIG. 11, the movable retainer 1084 is engaged with the stationary stopper 1086 by the second restoring force of the second elastic member 1082 and is disengaged from the movable stopper 1088. Thereby, the spool 70 is biased only by the first restoring force of the first elastic member 1080. Therefore, as shown in FIG. 15, in the lock range RI, only the first restoring force biases the spool 70 in the first direction "X".

Figure 12:
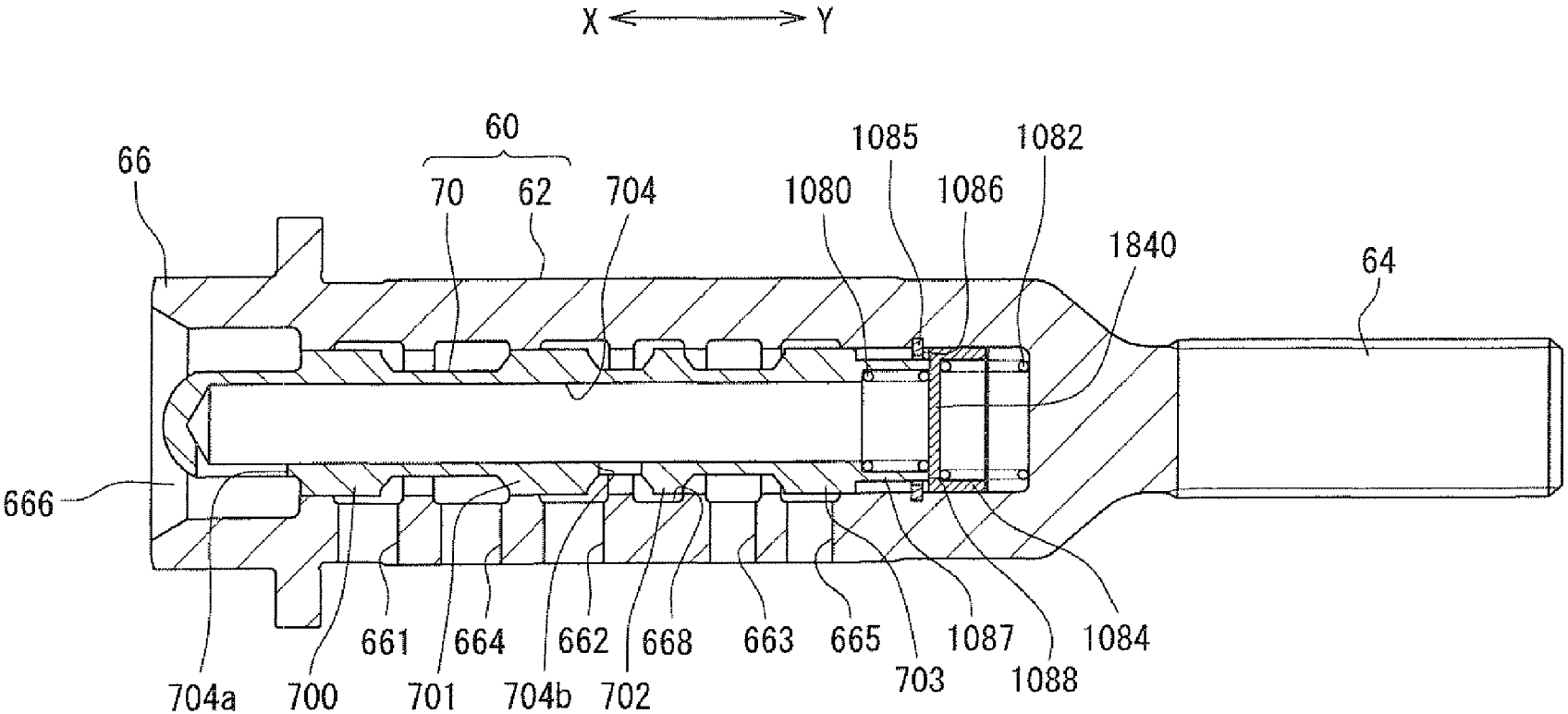
FIG. 12 is an enlarged cross sectional view showing the essential part of the control unit.
Figure 13:
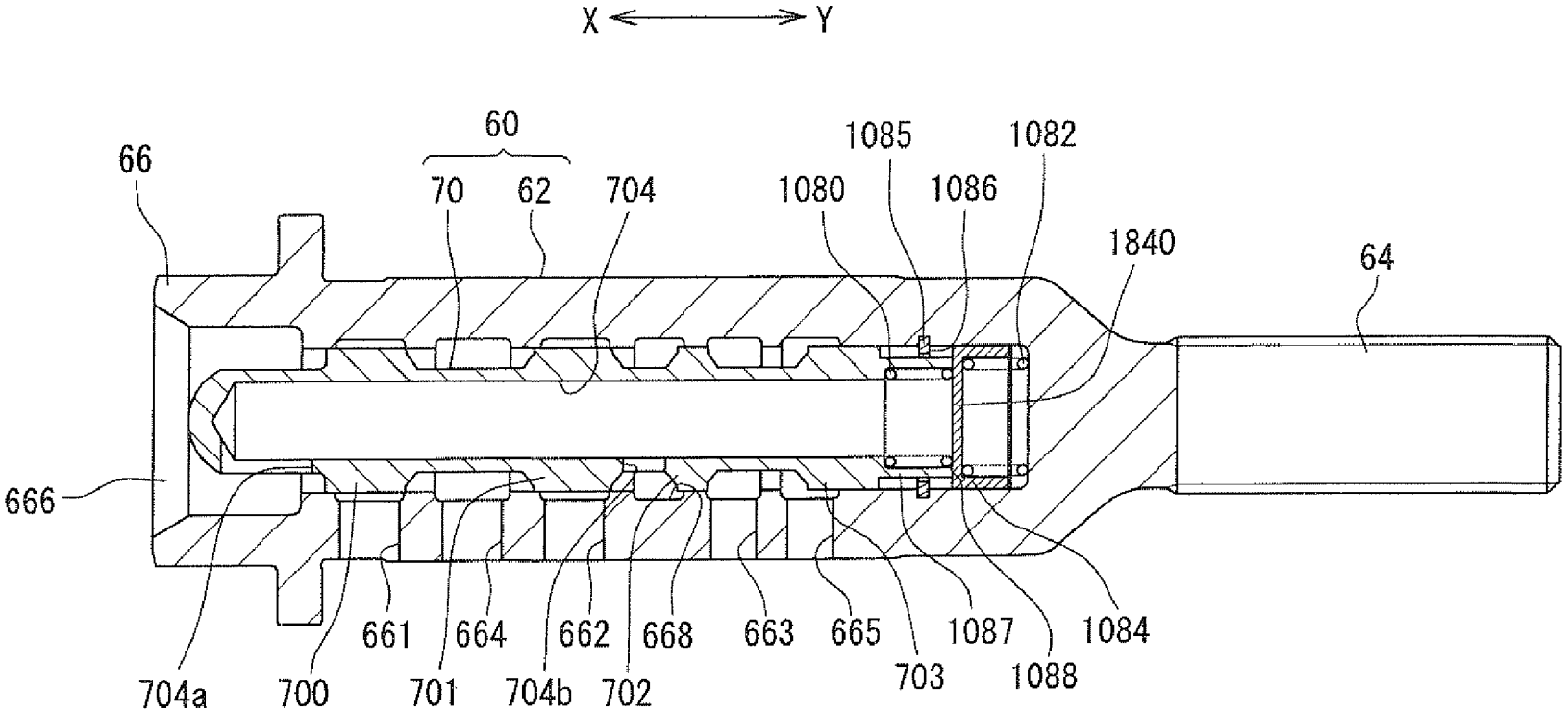
FIG. 13 is an enlarged cross sectional view showing the essential part of the control unit.
Figure 14:
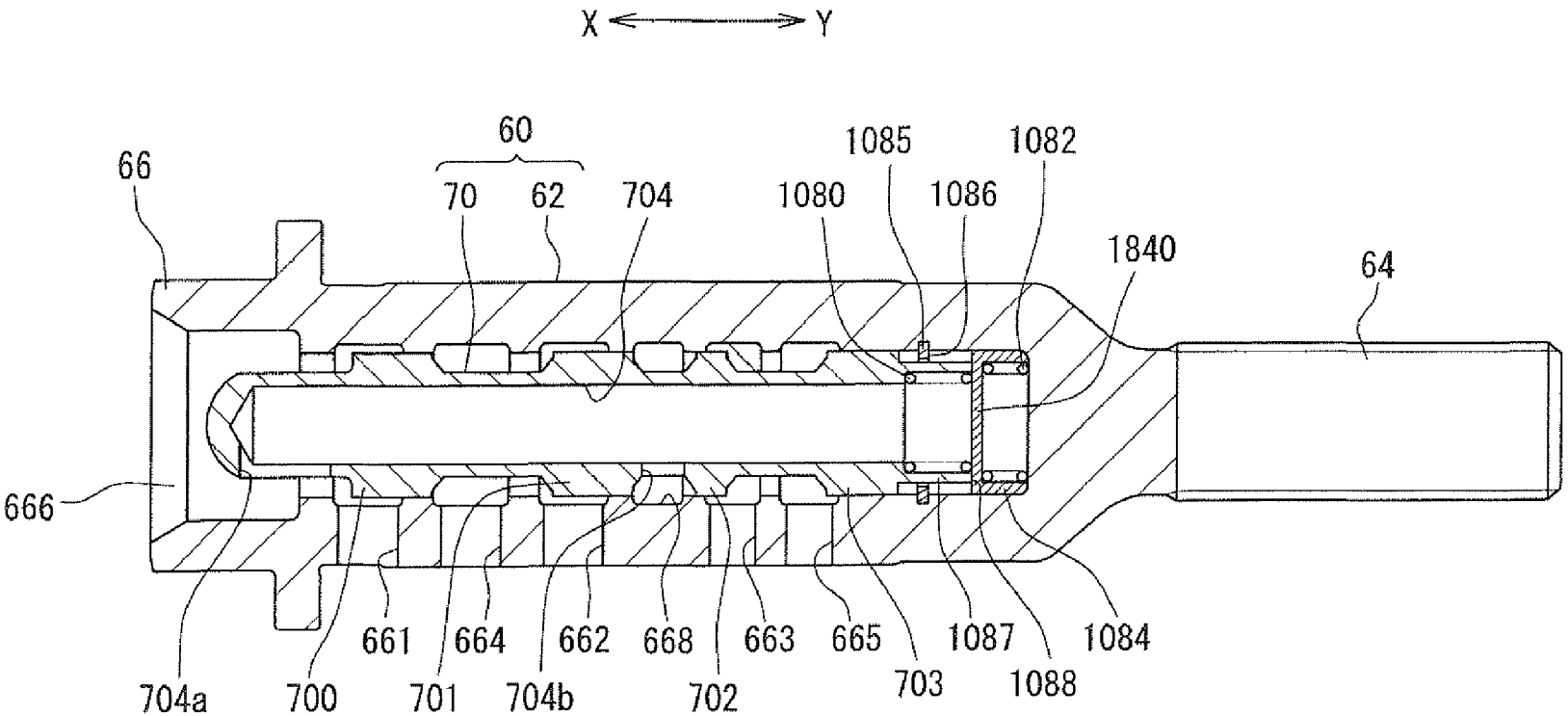
FIG. 14 is an enlarged cross sectional view showing the essential part of the control unit.

When the spool 70 is positioned in the advance range Ra as shown in FIG. 12, the hold range Rh as shown in FIG. 13, or the retard range Rr as shown in FIG. 14, the movable retainer 1084 is engaged with the movable stopper 1088 and disengaged from the stationary stopper 1086. Thereby, the spool 70 is biased by both of the first restoring force of the first elastic member 1080 and the second restoring force of the second elastic member 1082. Therefore, as shown in FIG. 15, in the advance range Ra, the hold range Rh, and the retard range Rr, a resultant force of the first and the second restoring force biases the spool 70 in the first direction "X".

According to the second embodiment, when the spool 70 is positioned at a limit position Pal of the advance range Ra, the biasing force biasing the spool 70 in the first direction "X" is stepwise varied by a specified variation width Ws2, as shown in FIG. 15. Since the specified variation width Ws2 is greater than an estimated value of an individual product variation ΔD in driving force which applied to the spool 70 in the second direction "Y", the driving force can be surely balanced with the biasing force within the specified variation width Ws2. Thus, a variation ΔP2 in the limit position Pal, which is defined by a balance between the biasing force in the first direction "X" and the driving force in the second direction "Y", depends on only individual product variation ΔU in the biasing force as shown in FIG. 15.

As mentioned above, according to the second embodiment, since the widths of the lock range RI and the advance range Ra are narrowed, the stroke of the spool 70 can be shortened so that the valve timing controller 1 can be downsized. In the second embodiment, the first elastic member 1080, the second elastic member 1082, the movable retainer 1084, the stationary stopper 1086, and the movable stopper 1088 function as a biasing means, and the movable retainer 1084, the stationary stopper 1086, and the movable stopper 1088 function as a setting means.

[Other Embodiment]

The present invention should not be limited to the disclosure embodiment, but may be implemented in other ways without departing from the sprit of the invention.

For example, the branch advance passages 42, 43, 44 may communicate with the retard chambers 26, 27, 28 respectively, and the branch retard passages 46, 47, 48 may communicate with the advance chambers 22, 23, 24 respectively, whereby the port 661 communicating with the retard chambers 26-28 through the passages 41, 42, 43, 44 may be fluidly connected to the main supply port 664. Moreover, the control valve 60 may be built in the vane rotor 14, or may be disposed upstream of the camshaft 2.

The present invention is applicable also to a controller which adjusts the valve timing of the exhaust valve, and a controller which adjusts the valve timing of the intake valve and the exhaust valve.

What is claimed is:

1. A valve timing controller for adjusting a valve timing of a valve by use of a hydraulic fluid supplied from a fluid supply source, the valve being opened/closed by a camshaft which is driven by a torque transmitted from a crankshaft of an internal combustion engine, the valve timing controller comprising:

a housing rotating synchronously with the crankshaft and defining a hydraulic chamber therein;

a vane rotor rotating synchronously with the camshaft, the vane rotor having a vane which divides the hydraulic chamber in its rotational direction, the vane rotor varying a rotational phase of the camshaft relative to the housing with the hydraulic fluid introduced into the hydraulic chamber;

a lock means having a lock chamber for locking the vane rotor relative to the housing by discharging the hydraulic fluid from the lock chamber, and for unlocking the vane rotor relative to the housing by introducing the hydraulic fluid into the lock chamber;

a valve body including an operation port which communicates with the hydraulic chamber, a supply port which receives the hydraulic fluid from the fluid supply source, and a discharge port from which the hydraulic fluid is discharged;

a valve member linearly moving in either of a first direction and a second direction opposite to the first direction, the valve member moving to a lock range including a stroke end in the first direction in order to fluidly connect the operation port with the supply port and fluidly connect the lock port with the discharge port, the valve member moving to a stroke range deviating from the lock range in the second direction in order to connect both of the operation port and the lock port with the supply port;

a biasing means for generating a biasing force biasing the valve member in the first direction; and a driving source for generating a driving force driving the valve member in the second direction, wherein the biasing means stepwise varies the biasing force when the valve member moves to be positioned at a limit position of the stroke range which confronts the lock range.

2. A valve timing controller according to claim 1, wherein the valve body accommodating the valve member is built in the vane rotor.

3. A valve timing controller according to claim 1, wherein the valve member sets a flow rate of the hydraulic fluid flowing from the supply port into the operation port as a maximum flow rate that is required in the stroke range when the valve member moves to be positioned at the limit position.

4. A valve timing controller according to claim 1, wherein the biasing means sets a stepwise variation width of the biasing force larger than an estimated width of an individual product variation in the driving force.

5. A valve timing controller according to claim 1, wherein the biasing means includes:

a first elastic member generating a first restoring force biasing the valve member in the first direction;

a second elastic member generating a second restoring force biasing the valve member positioned in the lock range in the second direction, the second restoring force being smaller than the first restoring force; and a setting means for setting a resultant force of the first restoring force and the second restoring force as the biasing force in the lock range, and for restraining the second restoring force from biasing the valve member and setting the first restoring force as the biasing force in the stroke range.

6. A valve timing controller according to claim 1, wherein the biasing means includes:

a first elastic member generating a first restoring force biasing the valve member in the first direction;

a second elastic member generating a second restoring force biasing the valve member in the first direction; and a setting means for restraining the second restoring force from biasing the valve member and setting the first restoring force as the biasing force in the lock range, and for setting a resultant force of the first restoring force and the second restoring force as the biasing force in the stroke range.

* * * * *